US006868943B1

(12) United States Patent
VanAcker, Jr.

(10) Patent No.: US 6,868,943 B1
(45) Date of Patent: Mar. 22, 2005

(54) SAFETY SYSTEMS AND METHODS FOR BOSUN'S CHAIRS

(76) Inventor: Henry VanAcker, Jr., 58 State St., Apt. 7, Rouse's Point, NY (US) 12979

( * ) Notice: Subject to any disclaimer, the term of this patent is extended or adjusted under 35 U.S.C. 154(b) by 0 days.

(21) Appl. No.: 10/074,713

(22) Filed: Feb. 13, 2002

(51) Int. Cl.[7] ..... E04G 3/00
(52) U.S. Cl. ..... 182/133; 182/142; 114/362
(58) Field of Search ..... 182/142, 145, 182/133, 134, 135, 136, 221, 9, 8; 114/362

(56) References Cited

U.S. PATENT DOCUMENTS

| | | | | |
|---|---|---|---|---|
| 1,409,800 A | * | 3/1922 | Turner | 182/129 |
| 1,955,473 A | * | 4/1934 | Raymer | 182/9 |
| 2,745,703 A | * | 5/1956 | Rose | 182/187 |
| 4,043,087 A | | 8/1977 | Connors | 52/127 |
| 4,181,194 A | | 1/1980 | Bassett et al. | 182/112 |
| 4,223,761 A | | 9/1980 | Sonnberger | 182/5 |
| 4,225,012 A | | 9/1980 | Hindle | 182/112 |
| 4,258,828 A | | 3/1981 | Evans | 182/95 |
| 4,407,391 A | * | 10/1983 | Greenway et al. | 182/9 |
| 4,432,470 A | | 2/1984 | Sopha | 222/135 |
| 4,542,804 A | | 9/1985 | Power | 182/38 |
| 4,613,013 A | | 9/1986 | Watling | 182/20 |
| 4,673,059 A | | 6/1987 | Kurtgis | 182/3 |
| 4,694,934 A | * | 9/1987 | Erickson | 182/142 |
| 4,883,146 A | | 11/1989 | Varner et al. | 182/5 |
| 6,082,492 A | | 7/2000 | Yerger | 182/136 |
| 6,382,356 B1 | * | 5/2002 | Skinner et al. | 182/133 |

FOREIGN PATENT DOCUMENTS

| | | | |
|---|---|---|---|
| GB | 762316 | | 11/1956 |
| JP | 2-101257 | * | 2/1990 |

* cited by examiner

*Primary Examiner*—Alvin Chin-Shue
(74) *Attorney, Agent, or Firm*—Heslin Rothenberg Farley & Mesiti P.C.; Victor A. Cardona, Esq.

(57) ABSTRACT

A safety device for a bosun's chair includes means for movably attaching the bosun's chair to a mast and means for braking the bosun's chair relative to the mast.

6 Claims, 2 Drawing Sheets

SAFETY SYSTEMS AND METHODS FOR BOSUN'S CHAIRS

TECHNICAL FIELD

This invention relates, in general to bosun's chairs and, in particular to, systems and methods for providing safety for bosun's chairs.

BACKGROUND ART

Bosun's chairs are commonly used to allow access to elevated locations. Bosun's chairs may include chairs ranging from a bare board to more elaborate designs, but what they have in common is the ability to be suspended from a rope or cord. When used on a boat, for example, one may use a bosun's chair to maintain sails or masts, install new fittings, change light bulbs, check or tape the rigging, or maintain other elevated portions of the boat.

An obvious problem relating to the use of a bosun's chair results from the use of a cord in combination with a winch and/or a person to raise the chair and maintain it in an elevated position. Particularly, a failure of the cord holding the bosun's chair, a winch, or the person holding the cord could result in injury or death to its occupant.

Thus, there is a need for safety systems and methods for bosun's chairs, particularly to improve safety in the event of the failure of a cord holding a bosun's chair.

SUMMARY OF THE INVENTION

The present invention provides, in a first aspect, a safety device for a bosun's chair which includes means for movably attaching the bosun's chair to a mast, and means for braking the bosun's chair relative to the mast.

The present invention provides, in a second aspect, a method for braking a bosun's chair. The method includes attaching the bosun's chair to a mast-attaching member and applying a force to the mast-attaching member to operatively brake the bosun's chair relative to the mast.

The present invention provides, in a third aspect, a safety device for a bosun's chair which includes a mast-attaching member moveably attached to a mast, and a brake adapted to brake the bosun's chair relative to the mast.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be readily understood from the following detailed description of preferred embodiments taken in conjunction with the accompanying drawings in which:

DETAILED DESCRIPTION

In accordance with the principles of the present invention, systems and methods for providing safety in the utilization of bosun's chairs are provided.

Figure 1:
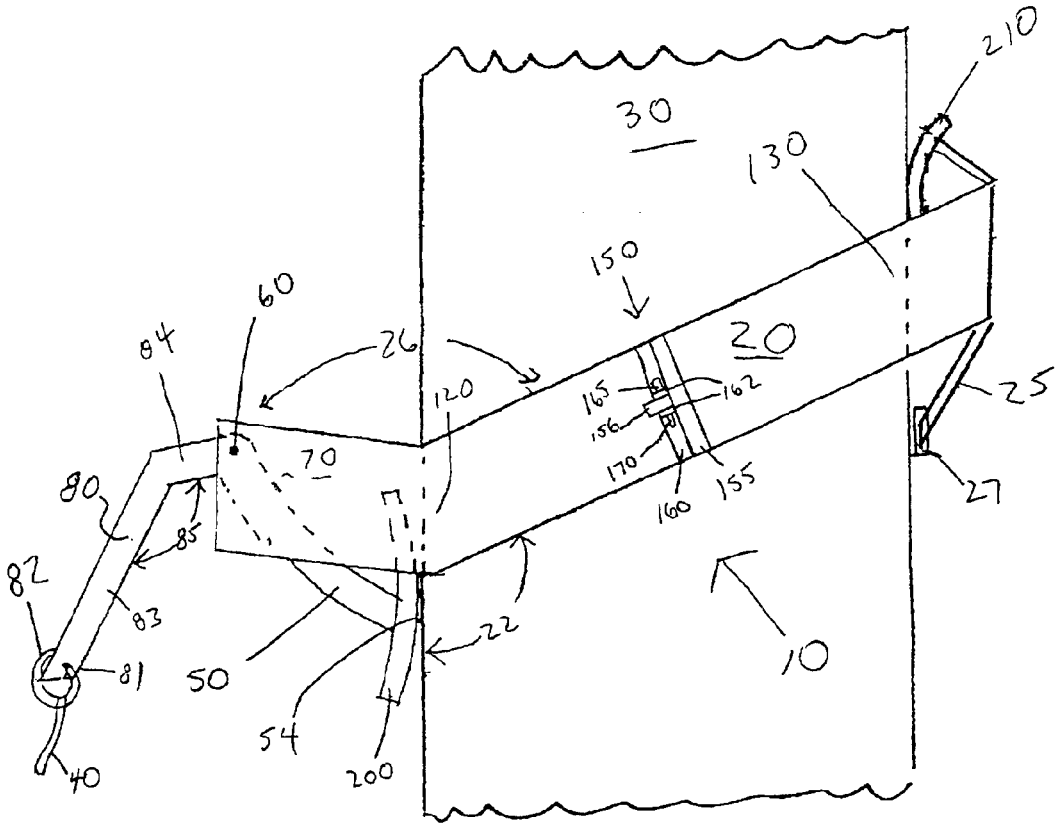
FIG. 1 is side elevational view of a safety device for a bosun's chair attached to a portion of a mast, in accordance with the present invention.

In an exemplary embodiment depicted in FIG. 1, a safety device 10 for a bosun's chair includes a mast-attaching member 20 which is attachable to a mast 30, for example, a mast of a boat. Also, safety device 10 may be connected to a cord 40 to thereby connect safety device 10 to a bosun's chair 90 (FIG. 2).

Safety device 10 includes a brake 50 which is pivotable about a pin 60 of an extension flange 70 of mast-attaching member 20. Extension flange 70 may be formed at an obtuse angle 26 to mast-attaching member 20. For example, angle 26 may be about 155 degrees. Brake 50 may extend vertically downward and/or obliquely toward mast-attaching member 20, and thus mast 30. An activation member 80 is connected to brake 50 and is pivotable about pin 60. Activation member 80 may extend vertically downward and/or obliquely away from extension flange 70. Further, activation member 80 may include a first portion 84 formed at an obtuse angle 85 to a second portion 83. As depicted in FIGS. 1–2, activation member 80 may be connected to cord 40, for example, via a metal connecting ring 82, and cord 40 may further be connected to a bosun's chair 90. Also, connected to bosun's chair 90 is a supporting cord 110 which may allow a person or object to be raised in bosun's chair 90, for example, to an elevated portion of a boat. Specifically, a winch 100 connected to supporting cord 110 may be utilized to raise bosun's chair 90 by utilizing a pulley 115 connected to a winch supporting portion 120 of mast 30. Alternatively, bosun's chair 90 may be raised by a person manually pulling on an opposite end of cord 110, or other similar means, as will be evident to those skilled in the art.

Figure 2:
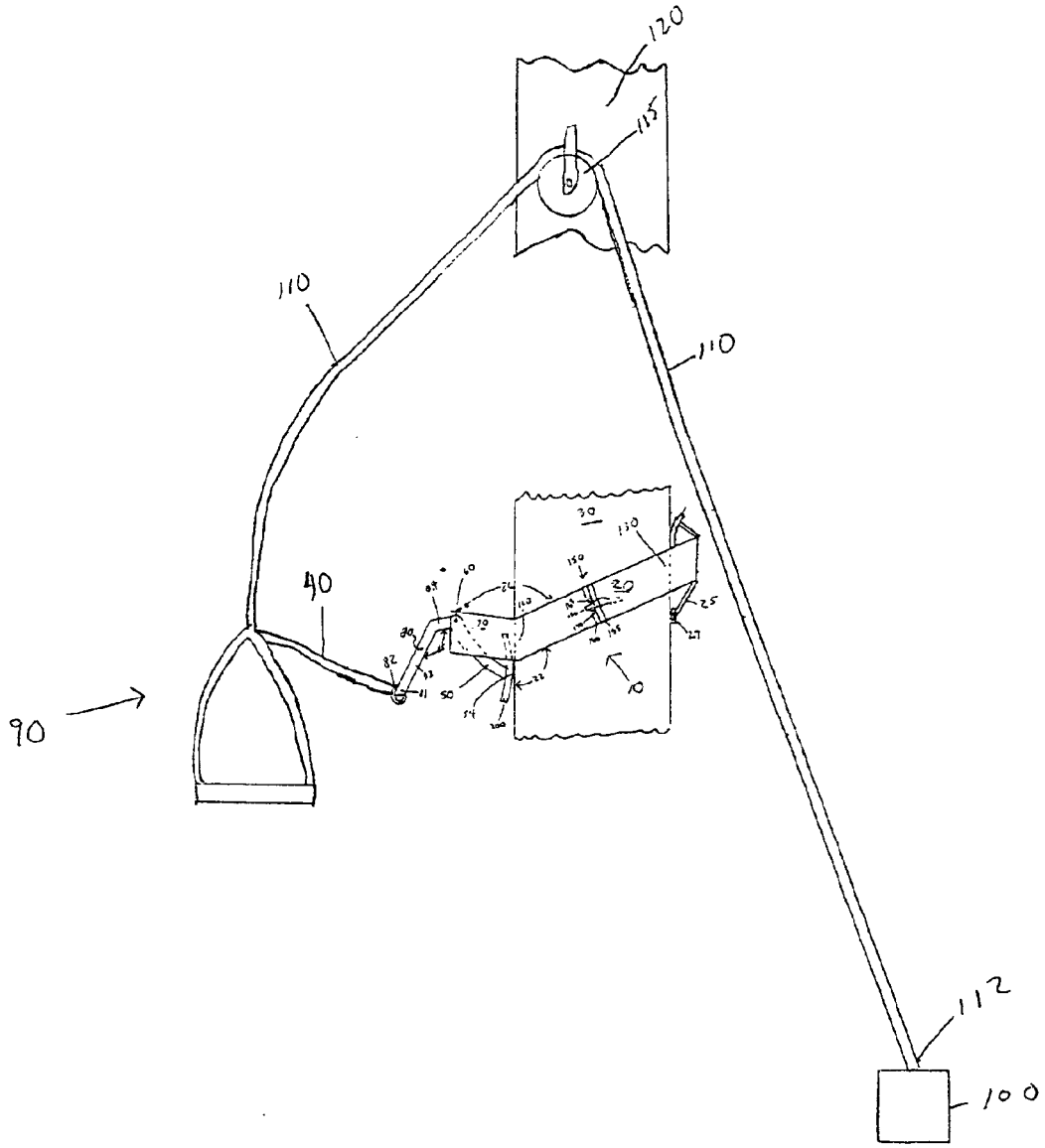
FIG. 2 is a side elevational view of the safety device of FIG. 1 attached to a bosun's chair, which is elevated and attached to a cord moveably connected to a pulley and a winch, in accordance with the present invention.

Referring to FIGS. 1 and 2, it is evident that cord 110 may be made of a variety of materials including rope or steel cable, for example. In the event that cord 110, pulley 115, winch 100 or a person holding a bottom end 112 of cord 110 was to fail to maintain bosun's chair 90 in a raised position, then bosun's chair 90 would fall vertically due to gravity. As bosuns's chair 90 falls, the weight of bosun's chair 90 and its occupant or cargo would take up any slack in cord 40 and place a force on activation member 80,connected to cord 40. This force on activation member 80 would cause activation member 80 to pivot downwardly thus causing brake 50 to pivot upwardly to contact mast 30 to brake mast-attaching member 20. The braking of mast-attaching member 20 would also brake bosun's chair 90 due to their connection by connecting cord 40. This braking of bosun's chair 90 would thereby inhibit or prevent harm to a person or object in bosun's chair 90. Specifically, the descent of bosun's chair 90 would be slowed thus reducing injury or damage on impact with a deck of a boat or other supporting surface (not shown). Alternatively, brake 50 would slow bosun's chair 90 to a stopped position prior to impacting a deck or other surface. Connecting ring 82 and end 81 of activation member 80 are preferably located below a mast-contacting portion 54. This difference in elevation allows activation member 80 to be a desired length such that activation member 80 may provide a desired mechanical advantage when a force is placed thereon. Specifically, a descent of bosun's chair 90 may be stopped or slowed more rapidly by a force placed on end 81 and ring 82 due to activation member 80 being formed at such a length.

Mast-attaching member 20 is openable at a connection point 150 and includes flanges 155 and 160 which may be connected by a bolt 165 and a nut 170, as depicted in FIG. 1. For example, flange 155 may include a protruding portion 156 and flange 160 may include receiving portions 162. Bolt 165 may threaded through openings (not shown) in protruding portion 156 and receiving portions 162, and nut 170 may be connected thereto. Thus, mast-attaching member 20 of safety device 10 may be attached to mast 30 such that it surrounds mast 30 and may move along an outer surface of mast 30, for example, up and down in a vertical manner. Also, mast-attaching member 20 may be formed in a circular shape to conform to the outer surface of mast 30. Further, mast-attaching member 20 may be formed of steel or other materials adapted to receive a force due to the weight of a person or cargo on the bosun's chair, without yielding or failing. Alternatively, flanges 155 and 160 may be connected, inter alia, by a bolt and a cotter pin (not shown) or a linchpin (not shown), as will be understood by those skilled in the art. By using a linchpin to connect flanges 155 and 160, for example, mast-attaching member 20 may be easily opened when mast-attaching member 20 encounters a horizontal cross-piece (i.e. a spreader, (not shown)) as mast-attaching member 20 moves along mast 30. The user may then easily reattach flanges 155 and 160 above the horizontal cross-piece using the linchpin as the user further ascends to allow mast-attaching member 20 to further move along mast 30. Moreover, bolt 165 is preferably inserted vertically downward such that a head (not shown) of bolt 165 retains bolt 165 in flange 155 and flange 160, even if bolt 170 or the linchpin (not shown) is not present, as will be understood by those skilled in the art.

As best illustrated in FIG. 1, mast-attaching member 20 may also include an angle-maintaining member 25. Mast-attaching member 20 may be maintained by angle-maintaining member 25 at an angle oblique to mast 30. For example, mast-attaching member 20 may be held by angle-maintaining member 25 such that a first end 120 is lower than a second end 130. In this instance, first end 120 could not rise above a point wherein mast-attaching member 20 is substantially perpendicular to mast 30. For example, an angle 22 between mast-attaching member 20 and mast 30 may be about 100 degrees. This allows brake 50 to readily contact mast 30 when supporting cord 110 fails, because it cannot rise above such perpendicular position. Thus brake 50 is held closer to a braking position adjacent to mast 30 than if it were allowed to rise with first end 120 above such perpendicular position.

In a preferred embodiment, mast-attaching member 20 is of a size and engages mast 30 at an angle such that it rests in a substantially stationary location abutting mast 30, due to angle-maintaining member 25 engaging mast 30 and activation member 80 being supported by cord 40. Further, mast-attaching member 20 may be easily moved in a vertical manner to an appropriate position by a user sitting in bosun's chair 90. For example, mast-attaching member 20 may be adapted to be easily pushed upward by the user along mast 30 at about a face-level of the user, as the user ascends in bosun's chair 90. Thus, the user may adjust safety device 10 to minimize a free-fall by the user in bosun's chair 90 in the event that supporting cord 110 was to fail. Particularly, little or no vertically downward movement by mast-attaching member 20 is desired on a failure of supporting cord 10. The user in bosun's chair 90 may thus fall only a distance about equal to a length of cord 40, for example about one foot. More desirably, mast-attaching member 20 rests on mast 30 at apposition such that there is little or no slack in cord 40. Thus, on a failure of supporting cord 110, there is little or no slack in cord 40 to be taken up and the user would fall a minimal distance. After the user has stopped falling, he may position himself on the mast 30 and exit bosun's chair 90 to allow him to descend mast 30. Alternatively, the user may push extension flange 70 in an upward direction to disengage mast-attaching member 20 thus allowing him to descend mast 30 with safety device 10.

As depicted in FIG. 1, brake 50 may further include a first friction pad 200 on its end adjacent to mast 30 and mast-attaching member 20 may include a second friction pad 210 on second end 130, as depicted in FIG. 1. Further, angle-maintaining member 25 may also include a third friction pad 27. These friction pads increase frictional resistance between mast 30 and mast-attaching member 20 to slow or stop mast-attaching member 20 relative to mast 30 when cord 110 fails. The friction pads may be formed of rubber or another material having similar frictional properties, for example. In another example of the present invention, which is not depicted, brake 50 and angle-maintaining member 25 may lack friction pads and second friction pad 210 may also be lacking. In such a case, brake 50 and angle-maintaining member 25 directly contact mast 30, as will be understood by these skilled in the art.

Numerous alternative embodiments of the present invention exist. For instance, mast-attaching member 20 may be formed of any shape to conform to a shape of a mast or other structure for holding a bosun's chair. Also, brake 50 may be activated by means other than activation member 80 and brake 50 pivoting about pin 60, as would be evident to those skilled in the art. Pin 60 might be a metal pin or it may comprise any other means of allowing brake 50 to be pivoted toward a mast when a force due to a falling bosun's chair is applied thereto. Further, brake 50 could be formed in any shape or size for braking a bosun's chair relative to a mast or other supporting structure. Moreover, angle maintaining member 25 may be formed of any shape adapted to maintain a mast-attaching member 20 such that one end is maintained at a point below its opposite end.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A safety device for a bosun's chair comprising:

a mast-attaching member movably attached to a mast of a boat;

a brake for braking the mast-attaching member relative to the mast of the boat, said brake being pivotally connected to said mast-attaching member;

an activation member being pivotally connected to said mast-attaching member and connected to said brake, said activation member connected to a cord connected to a bosun's chair, means for at least one of raising and lowering the bosun's chair relative to the mast of the boat, said means for at least one of raising and lowering the bosun's chair being connected to an elevated portion of the mast and comprising a lifting means and a second cord connected to the bosun's chair to support the bosun's chair to allow the bosun's chair to be at least one of raised and lowered; and said activation member pivotable to cause said brake to contact said mast to slow a descent of the bosun's chair in response to said cord, which is connected to the activation member being connected to the bosun's chair and a force being, placed on said activation member by the bosun's chair in response to a failure of said second cord to support a weight of the bosun's chair, said brake being separate from said means for at least one of raising and lowering the bosun's chair.

2. The device of claim 1 wherein said brake comprises at least one friction pad.

3. The device of claim 1 further comprising means for maintaining said mast-attaching member at an oblique angle relative to the mast when said mast-attaching member is attached to the mast.

4. The device of claim 1 further comprising means for inhibiting a side of said mast-attaching member adjacent to said brake from rising above a position substantially orthogonal to the mast when said mast-attaching member is attached to the mast.

5. The device of claim 1 wherein said mast-attaching member is configured to conform to a shape of an outer surface of the mast.

6. The device of claim 5 wherein said mast-attaching member is openable to allow said member to substantially encircle the mast.

* * * * *

UNITED STATES PATENT AND TRADEMARK OFFICE

CERTIFICATE OF CORRECTION

PATENT NO. : 6,868,943 B1
DATED : March 22, 2005
INVENTOR(S) : Van Acker, Jr.

It is certified that error appears in the above-identified patent and that said Letters Patent is hereby corrected as shown below:

Title page,
Item [12], delete "VanAcker" and insert -- Van Acker --
Item [76], Inventors, delete "VanAcker" and insert -- Van Acker --

Column 4,
Line 59, delete the word "the" and insert -- said --
Line 60, insert -- , -- after the word "member"
Line 61, delete "," after the word "being"

Signed and Sealed this

Thirty-first Day of May, 2005

JON W. DUDAS
*Director of the United States Patent and Trademark Office*